US007318478B2

(12) United States Patent
Royer

(10) Patent No.: US 7,318,478 B2
(45) Date of Patent: Jan. 15, 2008

(54) DOWNHOLE BALL CIRCULATION TOOL

(75) Inventor: Edward Shannon Royer, Missouri City, TX (US)

(73) Assignee: TIW Corporation, Houston, TX (US)

( * ) Notice: Subject to any disclaimer, the term of this patent is extended or adjusted under 35 U.S.C. 154(b) by 241 days.

(21) Appl. No.: 11/142,036

(22) Filed: Jun. 1, 2005

(65) Prior Publication Data

US 2006/0272825 A1 Dec. 7, 2006

(51) Int. Cl.
*E21B 33/00* (2006.01)

(52) U.S. Cl. ..... 166/332.4; 166/386; 166/373; 251/129.14

(58) Field of Classification Search ..... 166/373, 166/386, 334.2, 332.4; 251/129.14, 315.01
See application file for complete search history.

(56) References Cited

U.S. PATENT DOCUMENTS 4,291,722 A * 9/1981 Churchman ..... 137/496
4,657,092 A 4/1987 Franks, Jr.
4,987,841 A 1/1991 Rawson et al.
5,176,208 A 1/1993 Lalande et al.
5,335,731 A 8/1994 Riggenberg et al.
5,383,520 A * 1/1995 Tucker et al. ..... 166/142
5,402,850 A 4/1995 Lalande et al.
6,275,929 B1 8/2001 Blum et al.
2003/0136563 A1* 7/2003 Allamon et al. ..... 166/386

* cited by examiner

*Primary Examiner*—David Bagnell
*Assistant Examiner*—Brad Harcourt
(74) *Attorney, Agent, or Firm*—Browning Bushman P.C.

(57) ABSTRACT

A circulation tool 10 for use downhole in a well includes a housing 12 having one or more bypass ports 16 for circulation between a bore in the housing and an annulus surrounding the housing. A sleeve 68 is axially movable within the housing, and axially spaced seals 70, 74 seal between the sleeve and the housing when the sleeve is in the closed position. A ball 52 is rotatably mounted to the sleeve, and includes a seat 54 about a central bore 55 in the ball for engagement with a plug. When the sleeve closes off the circulation ports 16, the ball is rotated to the open position with a substantially full bore diameter.

20 Claims, 2 Drawing Sheets

DOWNHOLE BALL CIRCULATION TOOL

FIELD OF THE INVENTION

The present invention relates to circulation tools of a type used downhole in a well for transferring fluid through ports from a bore within the tool to an annulus surrounding the tool and for subsequently closing the ports to pass fluid through the tool. The circulation tools of the present invention are sometimes referred to as surge tools or surge reduction tools.

BACKGROUND OF THE INVENTION

Downhole circulation tools have been used for decades to selectively flow fluid from the interior of a tubing string or work string to the annulus surrounding the tool. Some tools have the ability to selectively close off circulation ports to subsequently pass fluid down the tubing string or work string. Many of these tools, however, make it difficult or unreliable to pass a cementing plug through the work string after the circulation ports are closed without damaging the plug. Other tools require that the work string be placed on bottom or engage some type of restriction in the well to cycle the tool. Various types of circulation tools have thus been devised for circulating fluid within a tubular string to an annulus, and for subsequently moving a sleeve to close the annulus so that fluid can be passed through the tool.

Prior art circulation tools for selectively closing off flow through a side port in the tool and for subsequently passing cement and cement plugs through the tool include tools with a deformable or expandable seat to allow the ball to pass through the seat and thus through the tool once the sleeve has shifted to close off flow ports in the tool. This type of tool significantly restricts the size of the cement plug which may be reliably passed through the tool, and the deformable seats may damage the plug wiper seals or rubber wafers while passing through the deformable seat. As a consequence, cementing operations are adversely affected since an unknown quantity of cement may pass by the wiper plug after the wiper plug has passed through the tool. Other types of tools employ a flangible disc within the bore of the tool. Pressure builds up on top of the disc to shift a sleeve to close off the circulation ports. A subsequent increase in pressure breaks the flangible disc. Fragments from the disc can be very damaging, however, to a cementing plug which is subsequently passed through the tool. Disc fragments may cut or tear at the wiper plug, thereby damaging the wiper plug.

Another type of tool utilizes a J-type mechanism for moving the sleeve between the open and closed positions. This type of tool or a tubular extending downward from the tool conventionally sits on the bottom of the well so that weight can be applied to manipulate the J-type mechanism.

Other types of surge tools do not provide substantially a full bore opening through the tool, and the restriction in the ID of the tool is thus a significant detriment to the use of the tool.

U.S. Pat. No. 6,275,929 discloses a circulation tool with axially moveable sleeves. Similar tools are disclosed in U.S. Pat. Nos. 6,571,875 and 5,176,208. U.S. Pat. No. 5,402,850 discloses a tool for reverse circulation of fluid in the wellbore. A circulation tool with wash ports is disclosed in U.S. Pat. No. 4,987,841. Another type of circulation tool is disclosed in U.S. Pat. No. 4,657,092. A downhole tool with a combination ball valve and sliding sleeve is disclosed in U.S. Pat. No. 5,335,731.

The disadvantages of the prior art are overcome by the present invention. An improved downhole circulation tool which may be reliably used with cementing operations is subsequently disclosed.

SUMMARY OF THE INVENTION

In one embodiment, a circulation tool for use downhole in a well is suspended in a well from a tubular string. The tool includes a tubular housing including one or more bypass ports for circulation between a bore within the housing and an annulus surrounding the housing. A sleeve is axially movable within the housing and supports axially spaced seals. A rotatable ball has a small diameter flow port therein and a seat surrounding the small diameter flow port for seating engagement with a ball or other plug. The ball is rotatable to an open position such that a large diameter through port in the ball has an axis generally aligned with the axis of the tubular housing.

In one embodiment, the large diameter port has a diameter of at least 90 percent of an innermost diameter of the axially movable sleeve. Cam members interconnected with the ball are movable within slots in the sleeve to rotate the ball to the open position.

These and further features and advantages of the present invention will become apparent from the following detailed description, wherein reference is made to the figures in the accompanying drawings.

DETAILED DESCRIPTION OF PREFERRED EMBODIMENTS

Figure 1A:
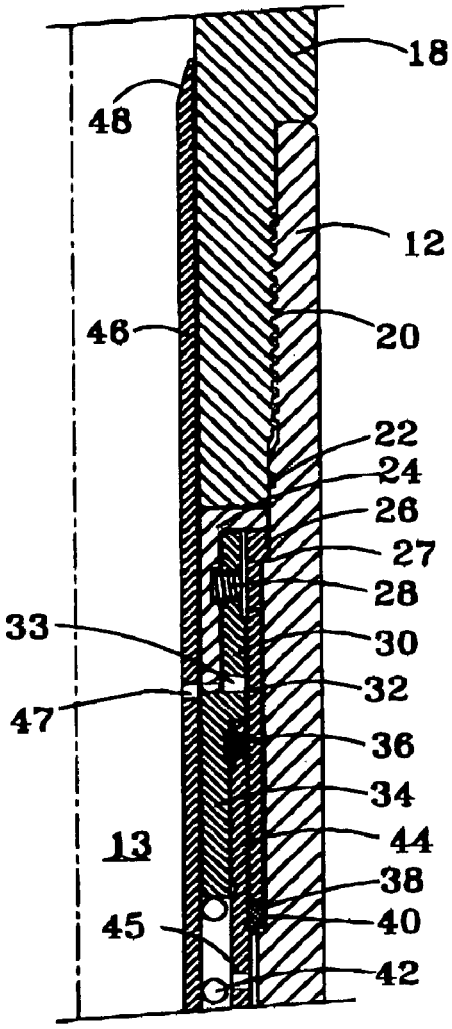
FIG. 1A is a half sectional view of an upper portion of the circulating tool positioned such that the circulation ports are open for communication with the annulus.
Figure 1B:
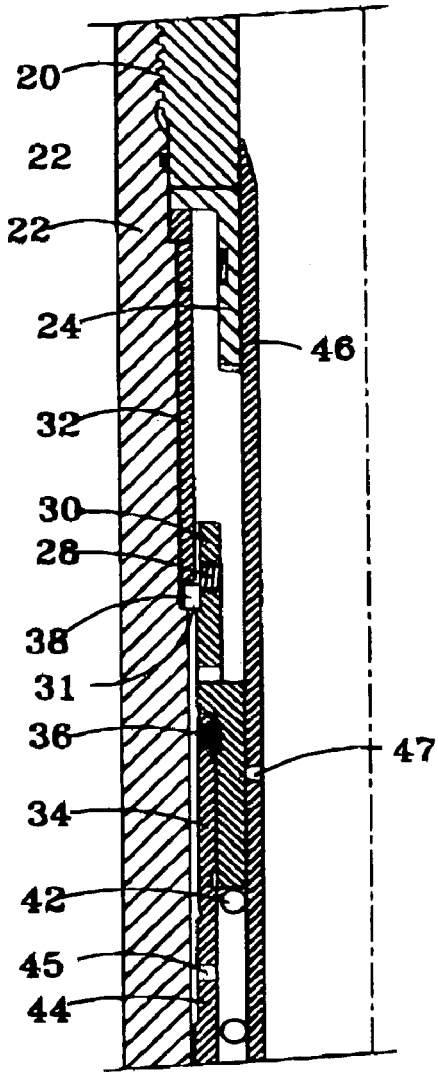
FIG. 1B is a half sectional view of the upper portion of the tool positioned such that the circulation ports are in the closed position.
Figure 1C:
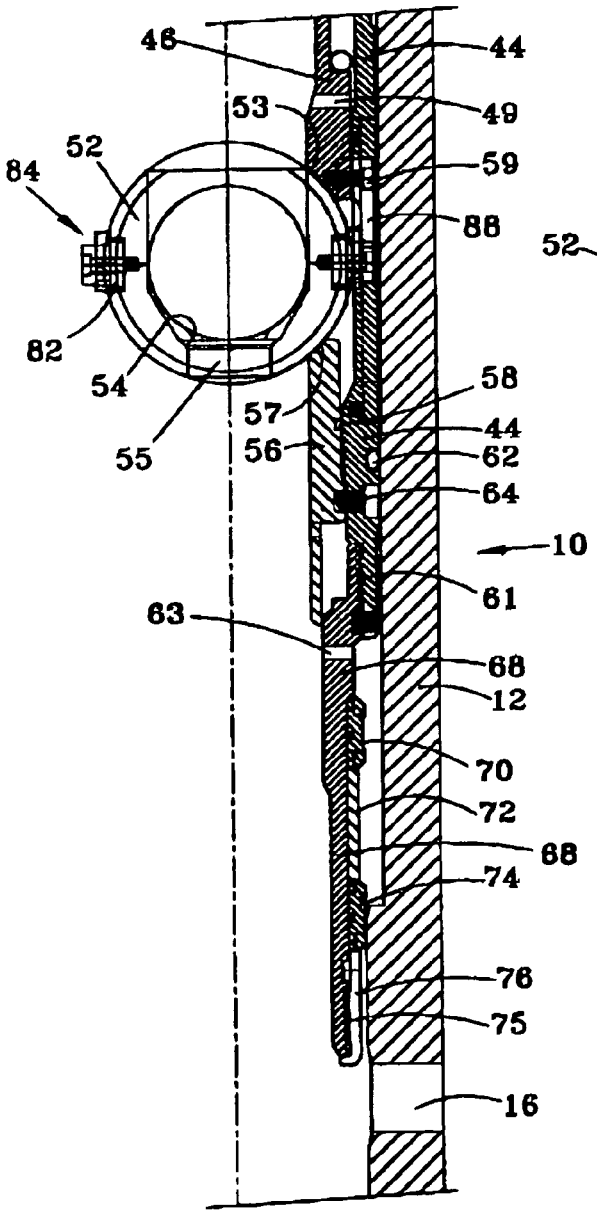
FIG. 1C is a half sectional view of a lower portion of the circulation tool with the circulation ports in the open position.

FIGS. 1A and 1C together illustrate a suitable embodiment of the circulation tool 10 according to the present invention. The upper portion of the tool includes a top connector 18 threadably connected at 20 to an outer sleeve shaped housing 12 which contains one or more circumferentially spaced circulation ports 16 therein. A seal 22 is provided between the top connector 18 and the housing 12, and an inner sleeve 46 having a tapered upper end 48 extends downward for positioning adjacent the ball 52 at seat 53. Upper piece 24 is fixed between sleeve 32 having enlarged head 26 and a lower surface on the threaded connector 18. Shear member 28 axially interconnects the upper piece 24 with sleeve 30, which has port 33 therein. The sleeve 46 is biased downward by coil spring 42 (see FIG. 1C), which acts on pusher 59 which acts on a roller which is part of cam assembly 82. The cam assembly 82 is attached to ball 52 via a screw. The spring force applied to the sleeve 46, pusher 59, and cam assembly 82 holds ball 52 against sleeve 56, which is pinned with shear members 64 to sleeve 44. Sleeve 32 is prevented from downward movement by the shoulder 27 on housing 12 adjacent head 26. The ring 38 at the lower end of sleeve 32 is contained by snap ring shoulder 40 on housing 12, and by sleeve 32. The ring 38 also engages a lower shoulder on the sleeve 44 to prevent upward movement of the sleeve 44. Port 33 in the sleeve 30, port 47 in the sleeve 46, port 45 in the sleeve 44, and port 49 in the sleeve 46 (see FIG. 1A) allow fluid communication between the interior of the tool and the chamber which houses the spring 42, and prevent pressure lock during actuation of the tool.

Figure 1D:
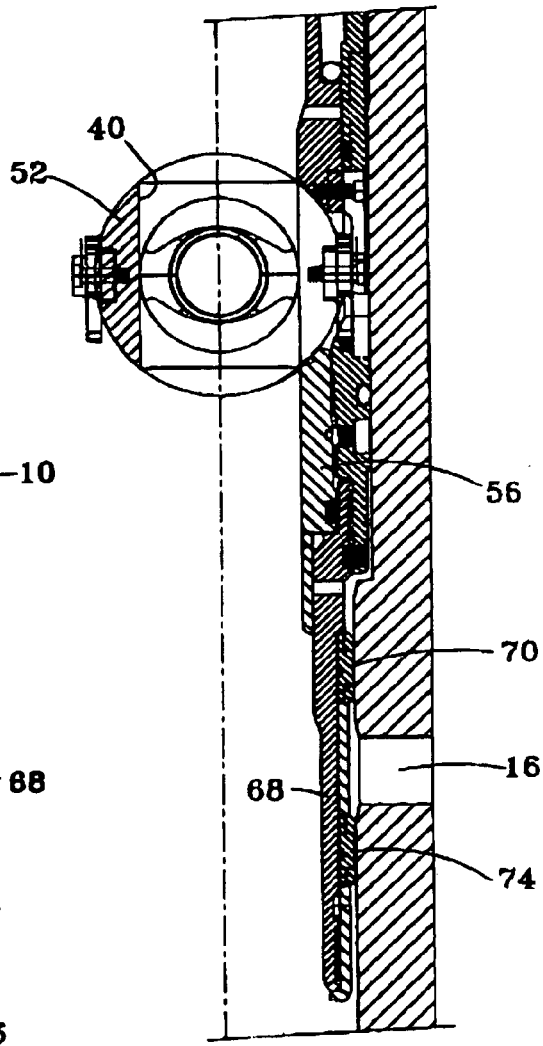
FIG. 1D is a half sectional view of a lower portion of the circulation tool with the circulation ports in the closed position.

Referring now to FIG. 1C, the ball 52 includes a pair of cam assemblies 82. FIG. 1C shows a small diameter port 55 having a seating surface 54 therein. FIG. 1D shows the ball rotated so that the large diameter bore 40 is in line with the bore 13 through the tool, with the bore 40 in the ball 52 having an interior diameter at least 90 percent as great as an innermost diameter of both the lower sleeve 56 and the upper sleeve 46.

Figure 2:
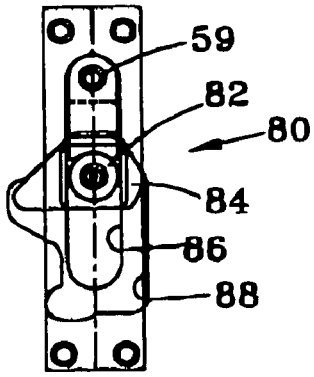
FIG. 2 is a side view of the ball rotating mechanism generally shown in FIGS. 1C and 1D.

Pusher 59 movably interconnects the lower end of sleeve 46 with sleeve 44, which has a slot 88 therein, as shown in FIG. 2. Sleeve 56 is provided below the ball 52, and is sealed thereto by O-ring 57. Seal 58 seals between the sleeve 56 and the sleeve member 44, which has a seal 62 for sealing engagement with the ID of the housing 12. Shear member 64 interconnects the sleeve 56 with the sleeve 44, and threads 61 interconnects the lower end of sleeve 44 with the sealing sleeve 68. Sealing sleeve 68 carries a seal 70 at its upper end and a seal 74 at its lower end, with spacer 72 provided between these seals. Lower end component 76 is threaded at 75 to the lower end of sleeve 68 for maintaining the seals 70 and 74 in position on the sleeve 68. FIG. 1C shows a port 16 open for circulation with the annulus, while FIG. 1D shows the port 16 sealed off by the seal 70 above the port 16 and seal 74 below the port 16. Through port 63 in the sleeve 68 prevents pressure lock during operation of the assembly while moving between the open port to closed port positions.

During operation of the circulation tool, fluid conventionally travels upward through the full diameter bore and passes outward through one or more of the circulation port 16 to the annulus surrounding the tool. Some fluid may also flow upward through the small diameter port 55 in the ball 52. When it is desired to close off the ports 16, e.g., for a cementing operation, multiple size or multiple diameter balls may be dropped to the seat of the surface 54 of the ball, thereby raising the pressure above the ball 52. This creates a downward force which acts on the assembly, shearing the pins 28 and moving the sleeves 30, 44, and 68 downward, thereby closing off the port 16. Shoulder 31 on sleeve 30 passes under the lock ring 38, thereby locking the tool in the circulation port closed position. After the sleeve 56 has closed off the ports 16, shear pins 64 shear during the final movement, lowering the ball 52 as it rotates to the full bore open position. With the sleeve 68 in the fully closed position and the ball 52 rotated to the full open position, a full bore is provided through the circulation tool.

The circulation tool of the present invention is particularly well suited for operations involving the run in of the liner in a well, and the subsequent cementing of the liner by pumping through the work string. When the liner is run in a well, a check valve at the bottom of the liner is conventionally opened so that well fluid enters and passes upward through the liner. The work string or drill pipe at the upper end of the liner thus begins to fill with fluid, and desirably most of that fluid passes through the circulation tool to the annulus rather than continuing up the drill string or work string. Once the liner is at bottom and positioned for cementing in place, a ball is dropped from the surface and lands on the ball 52, closing off the port 55 through the ball and creating a downward force to move the sleeve 68 to the closed position. As previously explained, the ball rotates after the sleeve 68 moves to the closed position to provide a full bore flow path through the circulation tool, at which time the dropped ball may be released to either be caught by a conventional ball catcher or passed to the bottom of the string. Plugs or darts may then be passed through the drill string or work string to cement the liner in place, with the darts or plugs passing through the open bore 13 in the circulation tool, which is not restricted and has no sharp edges to damage the plug or wiper.

For the embodiment depicted, the seals between the sleeve 68 and the housing 12 are provided on the sleeve. In other embodiments, the seals could be provided on the housing. In a preferred embodiment, a ball is provided with a hole therein, so that when the ball is closed some fluid can pass from below to above the ball. This construction allows fluid to drain from above to below the ball in the event the operator needs to pick up on the tubular string before setting the liner in place. Although various types of plugs may be used for seating with the flapper, a preferred plug is a ball. The seat on the ball is also configured for seating with balls of various sealing diameters, thereby increasing the versatility of the tool.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A circulation tool for use downhole in a well, the circulation tool suspended in the well from the tubular string, the circulation tool comprising:

a tubular housing having a central axis and including one or more bypass ports for circulation between a bore in the housing and an annulus surrounding the housing;

a sleeve axially movable within the housing between an open position and a closed position;

seals spaced above and below the one or more bypass ports for sealing between the sleeve and the housing when the sleeve is in the closed position; and a ball having a small diameter flow port therein and a seat surrounding the small diameter flow port for seating engagement with a plug, the plug engaging the seat to increase fluid pressure to move the sleeve to the closed position such that the seals seal between the sleeve and the housing above and below the bypass ports and to axially move the sleeve and rotate the ball to an open position, the ball in the open position having a large diameter through port with an axis generally aligned with the axis of the tubular housing.

2. A circulation tool as defined in claim 1, further comprising:

a shear member for retaining the sleeve in the open position and for shearing to release the sleeve to the closed position.

3. A circulation tool as defined in claim 1, further comprising:

a spring for biasing the sleeve to the sleeve open position.

4. A circulation tool as defined in claim 1, wherein the large diameter through port in the ball has a diameter of at least 90% of an innermost diameter of the sleeve.

5. A circulation tool as defined in claim 1, further comprising:

a cam member interconnected with the ball and movable with the ball to rotate the ball to the open position.

6. A circulation tool as defined in claim 1, wherein each of the axially spaced seals is supported on the sleeve.

7. A circulation tool as defined in claim 1, wherein the seat of the ball is configured for seating with plugs of various seating diameters.

8. A circulation tool as defined in claim 1, further comprising:

a spring for biasing the ball to the sleeve open position wherein the small diameter port is positioned for sealing engagement with a plug.

9. A circulation tool as defined in claim 1, wherein a cam member rotates the ball as it is lowered relative to the sleeve.

10. A circulation tool as defined in claim 1, wherein the cam member rotates the ball as the ball is lowered relative to the sleeve.

11. A circulation tool as defined in claim 10, further comprising:

a spring for biasing the sleeve to the sleeve open position.

12. A circulation tool as defined in claim 10, further comprising:

a locking member for preventing the sleeve when in the closed position from moving to the open position.

13. A circulation tool as defined in claim 10, further comprising:

a shear member for retaining the sleeve in the open position and for shearing to release the sleeve to the closed position.

14. A circulation tool as defined in claim 10, wherein each of the axially spaced seals is supported on the sleeve.

15. A circulation tool for use downhole in a well, the circulation tool suspended in the well from the tubular string, the circulation tool comprising:

a tubular housing having a central axis and including one or more bypass ports for circulation between a bore in the housing and an annulus surrounding the housing;

a sleeve axially movable within the housing between an open position and a closed position;

seals spaced above and below the one or more bypass ports for sealing between the sleeve and the housing when the sleeve is in the closed position; and a ball having a small diameter flow port therein and a seat surrounding the small diameter flow port for seating engagement with a plug, the plug engaging the seat to increase fluid pressure to move the sleeve to the closed position such that the seals seal between the sleeve and the housing above and below the bypass ports and axially move the sleeve and rotate the ball to an open position, the ball in the open position having a large diameter through port with an axis generally aligned with the axis of the tubular housing, the large diameter through port in the ball has a diameter of at least 90% of an innermost diameter of the sleeve; and a cam member interconnected with the ball and movable with the ball to rotate the ball to the open position.

16. A method of circulation fluid in a well, the method comprising:

providing a tubular housing having a central axis and including one or more bypass ports for circulation between a bore in the housing and an annulus surrounding the housing;

providing a sleeve axially movable within the housing between an open position and a closed position;

axially spacing seals above and below the one or more bypass ports for sealing between the sleeve and the housing when the sleeve is in the closed position; and providing a ball having a small diameter flow port therein and a seat surrounding the small diameter flow port for seating engagement with a plug, the plug engaging the seat to increase fluid pressure to move the sleeve to the closed position such that the seals seal between the sleeve and the housing above and below the bypass ports and axially move the sleeve to rotate the ball to an open position, the ball in the open position having a large diameter through port with an axis generally aligned with the axis of the tubular housing.

17. A method as defined in claim 16, further comprising:

biasing the sleeve to the sleeve open position.

18. A method as defined in claim 16, further comprising:

interconnecting a cam member with the ball to rotate the ball to the open position.

19. A method as defined in claim 16, wherein each of the axially spaced seals is supported on the sleeve.

20. A method as defined in claim 16, wherein a cam member rotates the ball as the ball is lowered relative to the sleeve.

* * * * *